US006051090A

United States Patent [19]

Healy et al.

[11] Patent Number: 6,051,090

[45] Date of Patent: Apr. 18, 2000

[54] METHOD OF STITCHING A SEWABLE MATERIAL AND A SHEET MATERIAL USABLE IN PERFORMING THE METHOD

[75] Inventors: Thomas Healy, Waukegan; Ronald Kronenberger, Riverwoods, both of Ill.

[73] Assignee: Omni Printing, Inc., Waukegan, Ill.

[21] Appl. No.: 09/063,176

[22] Filed: Apr. 20, 1998

[51] Int. Cl.[7] ..... D05B 39/00; D05C 9/04

[52] U.S. Cl. ..... 156/93; 112/475.18; 156/308.6

[58] Field of Search ..... 156/93, 336, 308.6; 112/475.18, 439

[56] References Cited

U.S. PATENT DOCUMENTS

| | | | |
|---|---|---|---|
| 1,856,556 | 5/1932 | Hemmerich | 112/475.18 |
| 4,053,986 | 10/1977 | Axelrod | 112/475.18 |
| 4,634,616 | 1/1987 | Musante | 112/475.18 |
| 4,784,714 | 11/1988 | Shibata | 156/354 |
| 5,257,823 | 11/1993 | Colvin | 283/117 |
| 5,354,339 | 10/1994 | Bodnar | 428/260 |
| 5,383,686 | 1/1995 | Laurash | 283/81 |
| 5,503,325 | 4/1996 | Nelson | 229/148 |
| 5,546,877 | 8/1996 | Moore | 112/103 |
| 5,597,635 | 1/1997 | Pusl | 428/43 |

*Primary Examiner*—Daniel Stemmer
*Attorney, Agent, or Firm*—Wood, Phillips, VanSanten, Clark & Mortimer

[57] ABSTRACT

A method of stitching a sewable material, which method includes the steps of: providing a support with a surface; providing a first sheet material with first and second sides; adhering the first side of the first sheet material to the surface of the support; adhering the sewable material to the second side of the first sheet material; and performing a stitching operation on the sewable material with the first sheet adhered to the surface of the support and the sewable material adhered to the first sheet. An adhesive on the first sheet, with a tackiness that increases upon being exposed to a reactant, is used to at least one of a) adhere the first side of the first sheet material to the surface of the support and b) adhere the sewable material to the second side of the first sheet material. The method further includes the step of exposing the adhesive to the reactant before the adhesive is used to at least one of a) adhere the first side of the first sheet material to the surface of the support and b) adhere the sewable material to the second side of the first sheet material.

15 Claims, 2 Drawing Sheets

METHOD OF STITCHING A SEWABLE MATERIAL AND A SHEET MATERIAL USABLE IN PERFORMING THE METHOD

BACKGROUND OF THE INVENTION

1. Field of the Invention

This invention relates to sewable materials as used to make various apparel items and, more particularly, to a method of stitching the sewable material using a sheet material that can be adhered to each of the sewable material and a support associated with a stitching apparatus. The invention is also directed to the sheet material usable in performing the method.

2. Background Art

It is well known to adhere a sheet material to a sewable material during the performance of a stitching operation as to develop an embroidered pattern. In one prior art system, a flat support surface is provided. The surface may be defined by a buckram sheet which is tensioned across a frame. The sewable material is attached through an adhesive in a taut state to the support surface. A stitching operation is then performed while controllably moving the support surface relative to a stitching needle to produce a desired stitching pattern. The sewable material can then be separated from the support surface and cut, sewn, or otherwise processed to produce the desired apparel item, which may be a shirt, cap, or the like.

Because the embroidery pattern is developed by shifting the support surface relative to the stitching needle, the quality of the embroidery is dictated in good part by the degree of precision in movement of the support surface. Consequently, it is important that the sewable material be positively fixed to the support surface to follow movement thereof so that the embroidered patterns are consistently and accurately produced.

Various systems have been heretofore devised to adhere the sewable material to the support surface. It is known to use a double-sided adhesive tape. High tenacity adhesives on a double-sided tape may make the tape difficult to handle and apply. This may result in longer than desired set up times for the system. Further, the tenacity of the adhesive may preclude clean separation of the tape from the support surface at the completion of an embroidery operation. Scraping and/or use of a solvent may be required to remove residue on the support surface before the application of a new piece of tape.

Further, adhesive from the tape may adhere to the sewable material after the sewable material is separated from the tape. If allowed to remain in place, the adhesive residue on the sewable material may detract from the appearance of the sewable material. If removed, a separate processing step is introduced.

Another problem with double-sided tapes is that the tapes are often relatively expensive.

A further problem with the double-sided tape is that this type of tape may be prone to fraying. In some operations it is desirable, when a first sewable material is peeled off of the double-sided tape after a stitching operation, to apply another sewable material to the same tape. In the event that the tape frays as an incident of the removal of the sewable material therefrom, the tape may have to be removed and replaced more frequently than desired. Again, this potentially adds both to production time and operating costs.

It is also known to use spray adhesives to bond the sheet material to the support surface and the sewable material to the sheet material. Currently available spray adhesives are commonly sticky and gummy. The adhesive may stick to and foul the stitching needles. More significantly, the adhesive may remain adhered to the sewable material and detract from the appearance of the completed product, or as previously mentioned, require a separate removal step.

Further, it is difficult to precisely control the distribution of spray adhesive. The spray adhesive may unintentionally be brought into contact with areas of the sewable material on which no adhesive is necessary and may become entrained in significant amounts in the air in the vicinity of the support surface such that the adhesive may be inhaled by workers. Aside from the fact that the adhesive may contaminate the surrounding environment, it may pose a health risk.

As an alternative to adhering the sewable material to the support surface, it is known to support the sewable material through a hoop assembly. The operator is required to captively maintain the sewable material between frictionally engaging, concentric hoop elements. This system has a number of drawbacks.

First of all, it may be difficult to mount the hoop assembly in relationship to the sewing head to produce the desired registration. Each hoop has a limited size within which the sewable material can be suspended, thereby potentially necessitating keeping on hand numerous different hoop sizes. Further, the set up of the hoop assembly and disassembly thereof may require a good degree of dexterity on the operator's part. This set up procedure may ultimately lead to carpel tunnel syndrome or other health problems. This clamping is particularly difficult with thicker sewable materials which must be placed captively between the hoop parts. Overall, this potentially leads to slower than desired set up and production times.

SUMMARY OF THE INVENTION

The invention is directed to a method of stitching a sewable material, which method includes the steps of: providing a support with a surface; providing a first sheet material with first and second sides; adhering the first side of the first sheet material to the surface of the support; adhering the sewable material to the second side of the first sheet material; and performing a stitching operation on the sewable material with the first sheet adhered to the surface of the support and the sewable material adhered to the first sheet. An adhesive on the first sheet, with a tackiness that increases upon being exposed to a reactant, is used to at least one of a) adhere the first side of the first sheet material to the surface of the support and b) adhere the sewable material to the second side of the first sheet material. The method further includes the step of exposing the adhesive to the reactant before the adhesive is used to at least one of a) adhere the first side of the first sheet material to the surface of the support and b) adhere the sewable material to the second side of the first sheet material.

The reactant may be applied through a roller, a brush, a sponge, by spraying, or by other means.

In one form, the adhesive is a dry gum adhesive.

The first sheet material may be fiber reinforced paper.

The adhesive, as described above, may be provided on each of the first and second sides of the first sheet material. In one form, the adhesive on the first side of the first sheet material is exposed to the reactant to increase the tackiness of the adhesive on the first side of the first sheet material before the first side of the first sheet material is adhered to the surface of the support, and the adhesive on the second side of the first sheet material is exposed to the reactant to increase the tackiness of the adhesive on the second side of the first sheet material before the sewable material is adhered to the second side of the first sheet material.

In one form, the adhesive is on at least the first side of the first sheet material and is placed on less than the entire area of the first side of the first sheet material.

Marking may be provided on the first side of the first sheet material to assist strategic application of at least one of a) an adhesive and b) a reactant which increases the tackiness of adhesive on the first side of the first sheet material.

Marking may be provided on the first sheet material to facilitate relative positioning of the first sheet material and an apparatus used to perform the stitching operation. As an example, the marking may include a grid.

A second sheet material may be applied to the sewable material, with the stitching being performed through the first and second sheet materials and the sewable material.

The invention also contemplates the combination of a sewable material and a sheet material having first and second sides with the first side of the sheet material adhered to the first side of the sewable material. The sheet material has a dry gum adhesive on at least one of the first and second sides to facilitate one of a) adhering of the second side of the sheet material to a support surface to hold the sheet material in an operative position relative to a stitching apparatus and b) adhering of the sewable material to the first side of the sheet material.

The dry gum adhesive may have a tackiness that increases with the application of water to the adhesive.

The sheet material may be fiber reinforced paper.

Marking may be provided on the sheet material to facilitate relative positioning of the sheet material and a stitching apparatus.

The invention is also directed to the combination of a sheet material made from fiber reinforced paper and having first and second sides and a water soluble dry gum adhesive applied to each of the first and second sides of the sheet material. The dry gum adhesive is applied over substantially the entire first side of the sheet material and strategically applied over less than the entire second side of the sheet material. By applying water to the adhesive on the second side of the sheet material, the second side of the sheet material can be adhered to a support associated with a stitching apparatus. By applying water to the adhesive on the first side of the sheet material, a sewable material can be adhered to the first side of the sheet material to facilitate movement of the sewable material through a support associated with a stitching apparatus during a stitching operation.

DETAILED DESCRIPTION OF THE DRAWINGS

Figure 1:
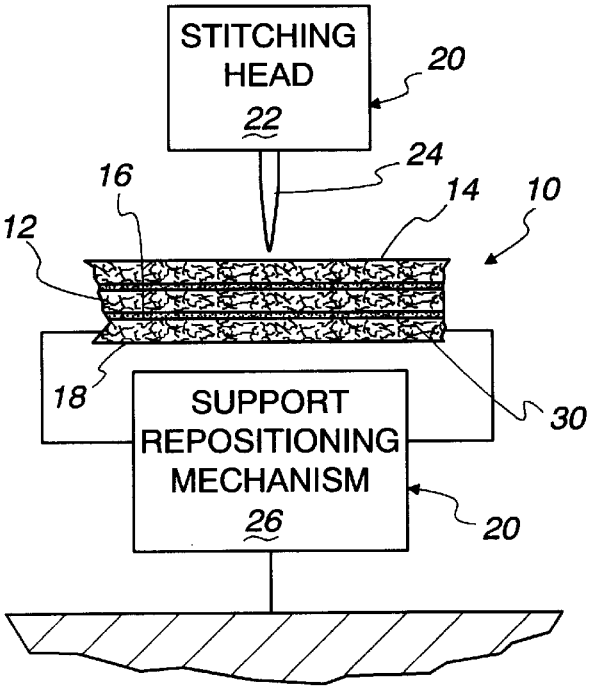
FIG. 1 is a schematic, partial cross-sectional view of a sheet material, according to the present invention, adhered to a sewable material and a support surface, in operative relationship to a stitching apparatus.

In FIG. 1, a system for stitching a sewable material, using the inventive method, is shown at 10. The system 10 consists of a sheet material 12 to which a sewable material 14 is adhered, with the sheet material 12 in turn being adhered to a surface 16 on a support 18, that is part of a stitching apparatus 20. The stitching apparatus 20 consists of a conventional stitching head 22 which, among other functions, reciprocatively drives a needle 24 to effect stitching, in conventional fashion, through the sewable material 14 and the sheet material 12.

As the stitching head 22 is operated, the support 18 is controllably moved through a support repositioning mechanism 26. The movement of the support 18 through the mechanism 26 dictates for the stitching pattern on the sewable material 14.

Figure 2:
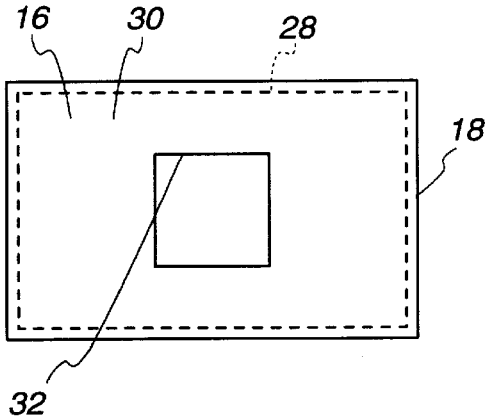
FIG. 2 is a plan view of the support surface on the stitching apparatus of FIG. 1.

In one exemplary form of the support 18, shown in FIG. 2, a peripheral frame 28 is provided across which a sheet of buckram cloth 30 is stretched to form the surface 16 to which the sheet material 12 is adhered. The sheet 30 has a cutout 32 which provides a sewing window, as hereinafter described.

Figure 3:
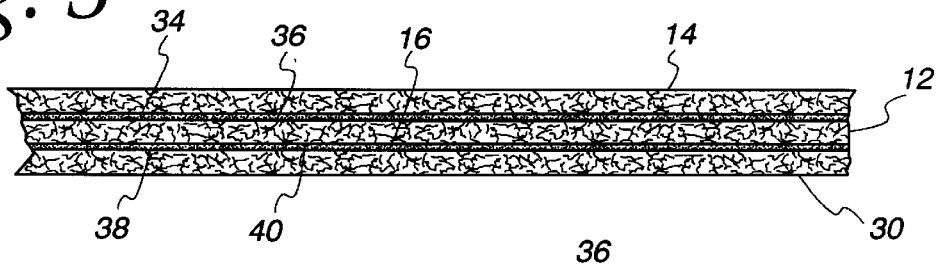
FIG. 3 is an enlarged, cross-sectional view of a sheet material according to the present invention, a support element defining the support surface, and sewable material in stacked relationship.
Figure 5:
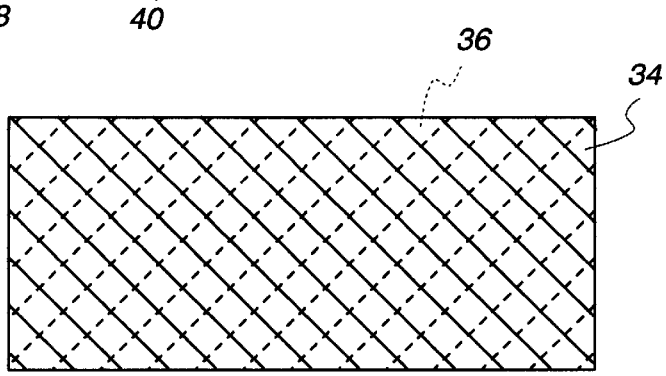
FIG. 5 is an enlarged, plan view of the inventive sheet material.

Referring now to FIGS. 1 and 3, a typical arrangement of layers prepared in anticipation of stitching is shown. The sheet material 12 is in one form a fiber reinforced paper. A product suitable for this purpose is currently sold commercially by Kimberly-Clarke Technical Paper, in Roswell, Ga. and identified with its trademark PREVAIL®. The weight of the paper may vary depending upon the particular application. As an example, the assignee herein intends to offer the paper in 50#, 60#, 85#, and 100#–150# stock.

A first layer 34 of adhesive is applied to a first side 36 of the sheet material 12. A second layer of adhesive 38 is applied to a second side 40 of the sheet material 12. Through the adhesive layer 34, the sewable material 14 is adhered to the sheet material 12. Through the adhesive layer 38, the sheet material 12 is adhered to the surface 16 of the sheet 30.

In a preferred form, the adhesive defining the layers 34, 38 is a dry gum adhesive. Preferably, the tackiness of the adhesive increases upon being exposed to as reactant. One suitable form of adhesive is a dextrin and starch based water soluble adhesive currently offered commercially by Ivex Packaging Corporation and identified as a polymeric adhesive. One formulation of a suitable dry gum adhesive, and the method of making the same, are described below.

| Item | Ingredient | Gal. | Wet Wt. | Dry Wt. |
|---|---|---|---|---|
| 1 | Tap Water | 240.00 | 2004.00 | 0.00 |
| 2 | Starch 890 | 66.07 | 800.00 | 800.00 |
| 3 | Dextrin 170IL | 132.15 | 1600.00 | 1600.00 |
| 4 | Sodium Nitrate | 2.12 | 40.00 | 40.00 |
| 5 | Caustic Soda | 0.22 | 4.00 | 4.00 |
| 6 | Yellow Protopet 2-A | 3.99 | 28.00 | 28.00 |
| 7 | Accostrength 86 | 9.20 | 96.00 | 96.00 |
| 8 | G-49-3 | 0.86 | 6.00 | 0.52 |
| 9 | Tap Water | 70.00 | 584.50 | 0.00 |

| | | | |
|---|---|---|---|
| Total Wet Wt. = | 5162.50 | % Solids (Wt) = | 49.75% |
| Total Dry Wt. = | 2568.52 | % Solids (Vol) = | 40.75% |
| Total Gallons = | 524.62 | % Water (Vol) = | 59.10% |
| Coating Density = | 9.84 | % Solvent (Vol) = | 0.14% |
| Solvent Density = | 6.59 | Lbs. Voc/Gal = | 0.01 |
| Total Solvent Wt. = | 4.88 | Lb/Gal-Water = | 0.02 |

Before starting to mix, a steam line and jacket are bled. When these are hot, Item No. 1 is metered in and the jets and jacket are turned on. Item Nos. 2–8 are then added and mixed for five minutes. The mixture is then heated at 205° F. for 20 minutes. Item No. 9 is then added and delivered to gum at 150° F.

A water soluble dry gum adhesive is desirable from the standpoint that in its initial dry state, it is only moderately "tacky". Once it is treated with a reactant, in this case water, the adhesive dissolves. Eventually, the tackiness of the adhesive, with the reactant applied thereto, increases to facilitate bonding of the sheet material to each of the sewable material 14 and sheet 30. The sheet material 12 with the dry gum in its initial dry state can be easily handled without inadvertent sticking to itself and other objects.

It should be understood that the sheet material 12 can have a dry gum adhesive on one or both sides 36, 40. In FIGS. 8–11, the sheet material 12' is shown with a layer 42 of dry gum adhesive on one side 44 of the sheet material 12'. The other side 46 of the sheet material 12' can be adhered to either the surface 16 or sewable material 14 through another type of adhesive or through other suitable means. However, it is generally preferred that the dry gum adhesive be used on both sides 44, 46.

Figure 8:
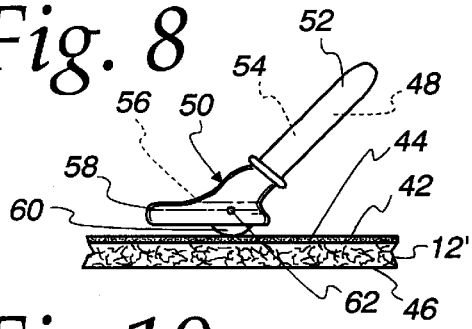
FIG. 8 is a fragmentary, side elevation view of another form of the inventive sheet material having a reactant applied thereto through the use of a roll on sponge.

As shown in FIGS. 8–11, a reactant, in this case water 48, can be applied to the adhesive layer 42 through various means. In FIG. 8, a roller type sponge apparatus 50 is show. The apparatus 50 consists of a handle 52 defining an internal reservoir 54 for a supply of water 48. The reservoir 54 is in communication with a chamber 56 bounded by a shroud 58. The shroud 58 supports a sponge roller 60 which is rotatable about an axis defined by a shaft 62. In operation, water from the reservoir 54 communicates to the chamber 56 and is from there delivered to the sponge 60, which upon being rolled or translated against the layer 42, distributes a film of water 48 on the layer 42.

Figure 9:
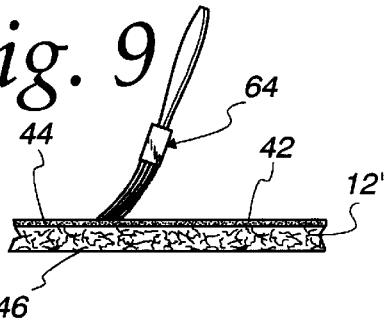
FIG. 9 is a view as in FIG. 8 with the reactant applied through the use of a brush.

In FIG. 9, the water application is accomplished through a conventional paint brush 64.

Figure 10:
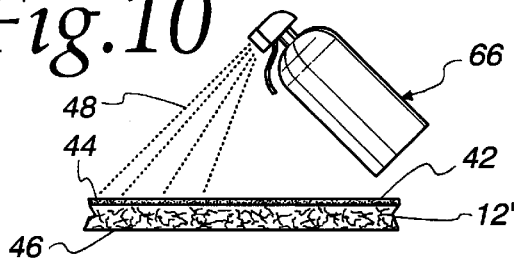
FIG. 10 is a view as in FIGS. 8 and 9 with the reactant applied through the use of a spray device.

In FIG. 10, a spray bottle 66 is utilized to spray a film of water 48 onto the layer 42.

Figure 11:
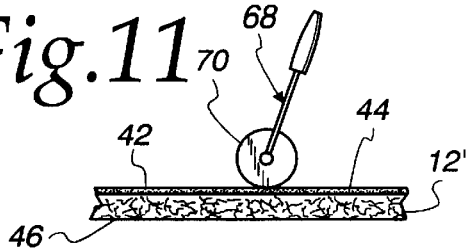
FIG. 11 is a view as in FIGS. 8–10 with the reactant applied through the use of a roller.

In FIG. 11, a roller apparatus is shown at 68 with a rotatable, porous sleeve 70. The roller 68 has the construction of a conventional type paint roller which causes water 48 to be applied in a thin film as the roller 68 moves over and against the layer 42.

In a typical operation, as seen in FIGS. 1–3, 5 and 6, water 48 is applied to the adhesive layer 38 on the side 40 of the sheet material 12. In one form of the method, the water 48 is applied only selectively over the layer 38. For example, there is no need for the adhesive in the region of the sheet material 12 that will overlie the cutout 32 in the sheet 30. To assist placement of the water, various markings 72, 74, 76 can be provided on the sheet material 12. For example, the markings 72 include the words "wet here" to allow the operator to easily visibly discern the areas where the adhesive is to be treated with water. The marking 74 includes the words "do not wet" and identifies the region that will register with the cutout 32 with the sheet material 12 operatively connected to the support 18. The marking 76 consists of shading and/or frame lines to identify the precise strategic location of the adhesive that is to be treated with the reactant.

Figure 6:
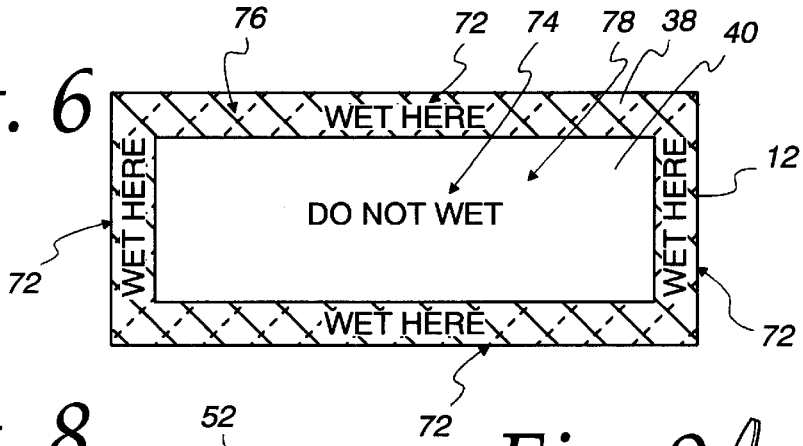
FIG. 6 is an enlarged, bottom view of the inventive sheet material.

As an alternative, the adhesive itself could be applied on less than the entire area of the sheet side 40, as shown in FIG. 6, using the same markings 72, 74, 76 to facilitate application of the adhesive. With this arrangement, the amount of adhesive employed can be minimized. Excess water will not contact any adhesive in the region at 78.

Still further, by reason of not using adhesive in the region 78, the needle 24 can be controlled so as not to penetrate any adhesive in the region 78 on the sheet side 40. This minimizes the likelihood of fouling of the needle 24 in operation. However, with the dry gum in its initial dry state, the adhesive tends not to adhere and foul the needle 24.

Preferably, the entire area of the side 36 of the sheet material 12 is covered with the adhesive layer 34 for a positive adherence of the sewable material 14 to the sheet material 12.

After the layer 38 of adhesive is treated with water on the side 40 of the sheet material 12, the side 40 is applied to the support surface 16 to adhere the sheet material 12 to the support surface 16. The adhesive layer 34 is then treated with water to increase its tackiness whereupon it can be adhered to the sewable material 14. As this occurs, the sewable material 14 is firmly adhered to the sheet 12, which in turn is stably maintained in place on the surface 16. Stitching can then be carried out through the apparatus 20 in conventional fashion.

Figure 4:
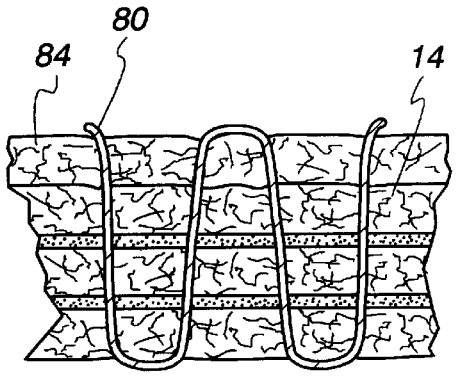
FIG. 4 is a view as in FIG. 3 and further showing a second sheet material which functions as a backing layer and with representative stitching through all of the stacked materials.

In FIG. 4, thread 80 is shown stitched in normal fashion using the apparatus 20. In this case, the method is modified by including a second sheet material 84, which serves as a backing layer to prevent the thread 80 from being drawn through the sewable material 14. The sheet material 84 may be a plastic, non-woven material, or the like, which can be relatively easily removed, torn away from the sewable material 14, or dissolved, as under heat.

Figure 7:
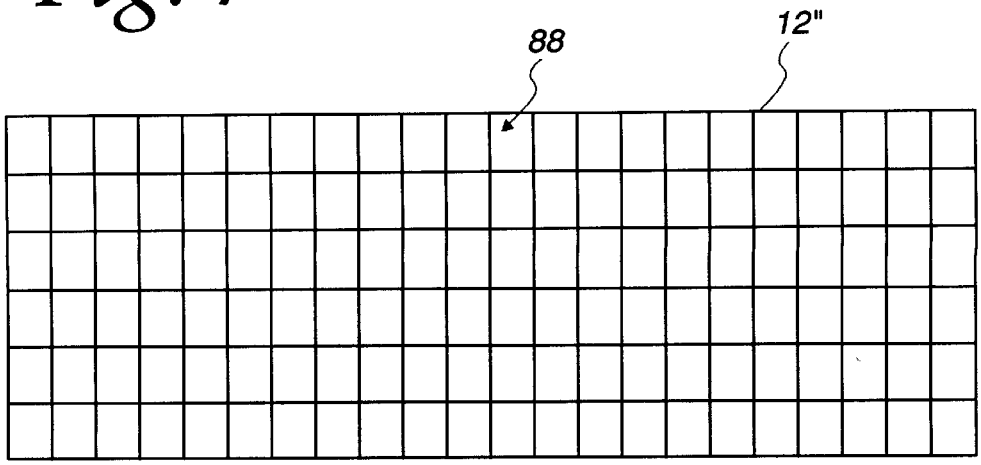
FIG. 7 is an enlarged top/bottom view of the inventive sheet material with markings thereon to facilitate one of positioning of the sheet material relative to the stitching apparatus, location of a sewable material on the sheet material, strategic application of adhesive to the sheet material, and strategic application of a reactant to the adhesive.

In FIG. 7, a modified form of sheet material 12" is shown which includes markings 88 thereon in the form of a grid which facilitates both alignment of the sewable material 14 relative to the sheet material 12 and alignment of the sheet material 12 with the sewable material 14 adhered thereto relative to the stitching apparatus 20.

The sheet material 12, 12', 12" can be made in a wide range of sizes. For example, 6"×6" up to 18"×18" is a range that accommodates most applications. The sheet material 12, 12', 12" may be cut from larger sheets, such as sheets on the order of 24"×40", or from rolls ranging from 6"–70" in width.

The foregoing disclosure of specific embodiments is intended to be illustrative of the broad concepts comprehended by the invention.

We claim:

1. A method of stitching a sewable material, said method comprising the steps of:

providing a support with a surface;

providing a first sheet material with first and second sides;

adhering the first side of the first sheet material to the surface of the support;

adhering the sewable material to the second side of the first sheet material; and performing a stitching operation on the sewable material with the first sheet adhered to the surface of the support and the sewable material adhered to the first sheet, wherein there is an adhesive with a tackiness that increases upon being exposed to a reactant on a predetermined area of the first sheet that is used to at least one of a) adhere the first side of the first sheet material to the surface of the support and b) adhere the sewable material to the second side of the first sheet material, said method including the steps of exposing the adhesive to the reactant over less than the predetermined area before the adhesive exposed to the reactant is used to at least one of a) adhere the first side of the first sheet material to the surface of the support and b) adhere the sewable material to the second side of the first sheet material.

2. The method of stitching a sewable material according to claim 1 wherein the step of exposing the adhesive to the reactant comprises the step of applying the reactant to the adhesive through the use of a roller.

3. The method of stitching a sewable material according to claim 1 wherein the step of exposing the adhesive to the reactant comprises the step of applying the reactant to the adhesive through the use of a brush.

4. The method of stitching a sewable material according to claim 1 wherein the step of exposing the adhesive to the reactant comprises the step of applying the reactant to the adhesive through the use of a sponge.

5. The method of stitching a sewable material according to claim 1 wherein the step of exposing the adhesive to the reactant comprises the step of spraying the reactant on the adhesive.

6. The method of stitching a sewable material according to claim 1 wherein the adhesive comprises dry gum.

7. The method of stitching a sewable material according to claim 1 wherein the first sheet material comprises fiber reinforced paper.

8. The method of stitching a sewable material according to claim 1 wherein the reactant is water.

9. The method of stitching a sewable material according to claim 1 wherein there is an adhesive with a tackiness that increases upon being exposed to a reactant on each of the first and second sides of the first sheet material and the adhesive on the first side of the first sheet material is exposed to a reactant to increase the tackiness of the adhesive on the first side of the first sheet material before the first side of the first sheet material is adhered to the surface of the support and the adhesive on the second side of the first sheet material is exposed to a reactant to increase the tackiness of the adhesive on the second side of the first sheet material before the sewable material is adhered to the second side of the first sheet material.

10. The method of stitching a sewable material according to claim 1 wherein the adhesive is on the first side of the first sheet material, the first side of the first sheet material has an area and the adhesive is on less than the entire area of the first side of the first sheet material.

11. The method of stitching a sewable material according to claim 10 wherein the adhesive is on the first side of the first sheet material and there is marking on the first side of the first sheet material to assist strategic application of at least one of a) adhesive and b) a reactant which increases the tackiness of adhesive on the first side of the first sheet material.

12. The method of stitching a sewable material according to claim 1 wherein there is marking on the first sheet material to facilitate relative positioning of the first sheet material and an apparatus used to perform a stitching operation.

13. The method of stitching a sewable material according to claim 12 wherein the marking comprises a grid.

14. The method of stitching a sewable material according to claim 1 including the steps of providing a second sheet material and applying the second sheet material to the sewable material, wherein the step of performing a stitching operation comprises the step of stitching through the first and second sheet material and the sewable material.

15. The method of stitching a sewable material according to claim 1 including the step of marking the sheet material to facilitate strategic exposure of the adhesive to the reactant.

* * * * *